United States Patent [19]

Nazzarro

[11] Patent Number: 4,860,688

[45] Date of Patent: Aug. 29, 1989

[54] DEPILATORY WAX AUTOMATIC DISPENSER ON DEPILATORY STRIPS

[76] Inventor: Ugo Nazzarro, Via dei Coltelli, 28/2, I-40124 Bologna, Italy

[21] Appl. No.: 171,802

[22] Filed: Mar. 22, 1988

[30] Foreign Application Priority Data

Apr. 6, 1987 [IT] Italy ..... 3418 A/87

[51] Int. Cl.[4] ..... B05C 11/00

[52] U.S. Cl. ..... 118/694; 118/410; 118/415

[58] Field of Search ..... 118/410, 411, 25, 694, 118/415

[56] References Cited

U.S. PATENT DOCUMENTS

| | | | |
|---|---|---|---|
| 449,670 | 4/1891 | Denney | 118/415 |
| 1,613,521 | 1/1927 | Martin | 118/411 X |
| 3,052,565 | 9/1962 | Chinn et al. | 118/411 X |
| 3,130,876 | 4/1964 | Baker | 118/410 X |
| 3,859,985 | 1/1975 | Fiveash | 401/2 |
| 4,330,358 | 5/1982 | Grabmaier et al. | 118/415 X |
| 4,683,837 | 8/1987 | Linke et al. | 118/694 X |
| 4,746,545 | 5/1988 | McIntyre | 118/415 X |

*Primary Examiner*—Shrive Beck
*Assistant Examiner*—Alain Bashore
*Attorney, Agent, or Firm*—Stevens, Davis, Miller & Mosher

[57] ABSTRACT

A depilatory wax automatic dispenser on depilatory strips essentially comprising: a basement for a pot; an electrical resistance immerged in said pot; a cavity made in said basement near said resistance; a batcher cylinder closing said cavity; a device to positionate a strip at a preselected clearance from said cylinder; at least one outlet port in said cylinder to dispose wax on said strip slipping below said port; means for maneuvering said cylinder from a first closing position to a second opening position for said port; elements for disposing said strip in a horizontal attitude when said cylinder is in said second position; electrical feeding control means for said resistance.

11 Claims, 5 Drawing Sheets

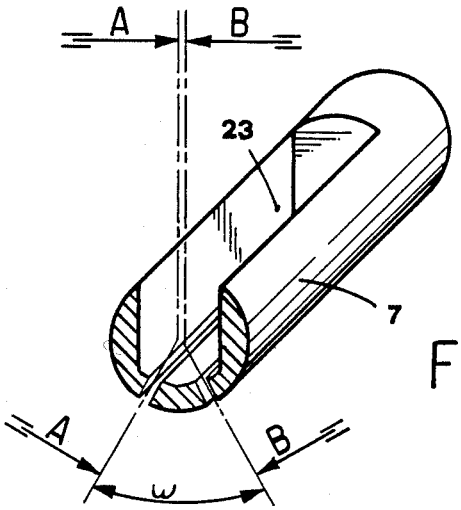
FIG. 5
FIG. 5a
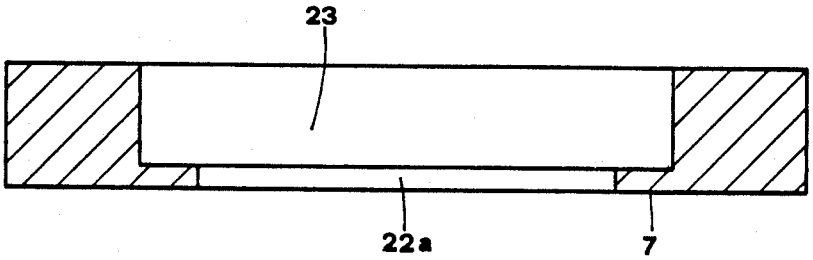
FIG. 5b
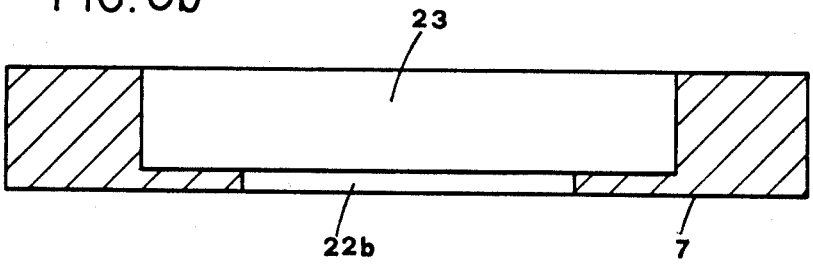

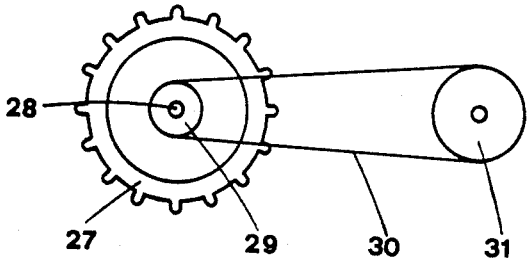
FIG.6
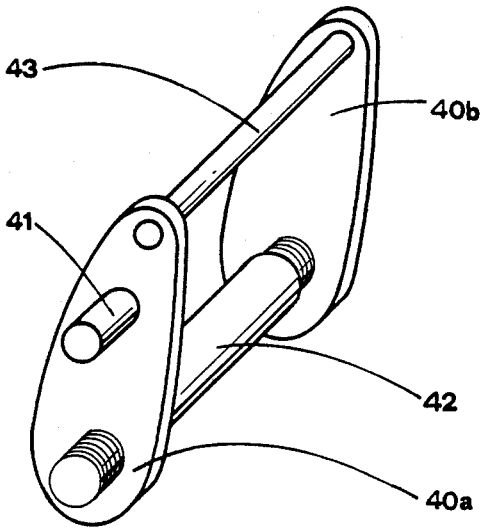
FIG.7
FIG.8
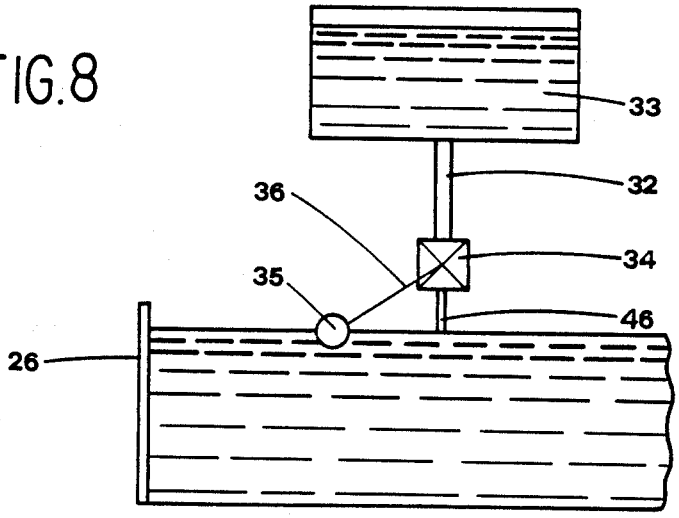

DEPILATORY WAX AUTOMATIC DISPENSER ON DEPILATORY STRIPS

This invention refers to a device able to coat paper, cellophane or cotton fabric strips with cosmetic waxes.

In particular it refers to a device by which it is possible to place a wax layer having predetermined width and thickness onto one of said strips.

The waxes which are used for depilation are substantially of two types: a first type is water-soluble and consists of water-dispersed sugary and albuminous substances; the presence of the albuminous substances allows to reach a colloidal state having a viscosity decreasing with temperature. A second type is liposoluble and consists of colophonies or saturated oils; this second type also having a viscosity which decreases as a consequence of temperature increase. The choice of a wax of the first or second type does not interest this disclosure.

Presently in the beauty saloons the hair removing treatment is accomplished by using one of the aforesaid waxes which is kept at a suitable temperature within a pot and which is removed from said pot to be spread on the skin by using a spatula or a similar tool. Then the spread wax is removed together with the superfluous hair by using paper, cellophane or cotton fabric strips. The result of this operation depends on the skill of the operator however it is difficult to solve the following problems:

to place on the skin subjected to hair-removing treatment a sufficiently thin layer of wax to allow the subsequent complete removal thereof but which however allows a complete hair-removing;

to prevent the wax temperature to be so high to cause pain to the skin.

This invention is intended to remedy these drawbacks. The invention as it is characterized in the claims solves the problem of how to create a depilatory wax automatic dispenser on depilatory strips.

By using a dispenser of this type the following result is achieved: a layer of wax is placed on a paper, cellophane or cotton fabric strip at an uniform thickness on the whole length of the strip; said layer having desired and controlled thickness and width.

Therefore the wax is not spread directly on the skin but is first placed on one of said strips which is then applied on the skin from the part on which the wax has been placed.

The advantages offered by using the present invention essentially consists in the fact that the times for preparing the depilatory strips are very short thus preventing the excessive hardening of the wax which would avoid a right application of the strips on the skin; furthermore with the present invention it is possible to maintain only a part of the wax housed in the pot at an optimal temperature to place it on a strip, thus preventing the total mass of the wax housed in said pot to have an excessive temperature.

Finally the device according with the present invention is extremely durable.

The invention is described in great detail below with reference to drawings which represent preferred but not limitative embodiments in which:

FIGS. 5, show a batcher cylinder with two outlets ports 5*a*, 5*b* for placing the wax according to the desired witdth.

FIG. 6 shows schematically a device for automatic advancement of a paper, cellophane or cotton fabric strip.

FIG. 7 shows a device for adjusting the thickness of the wax on a strip.

FIG. 8 Shows schematically a device to maintain the level of the wax constant.

Figure 1:
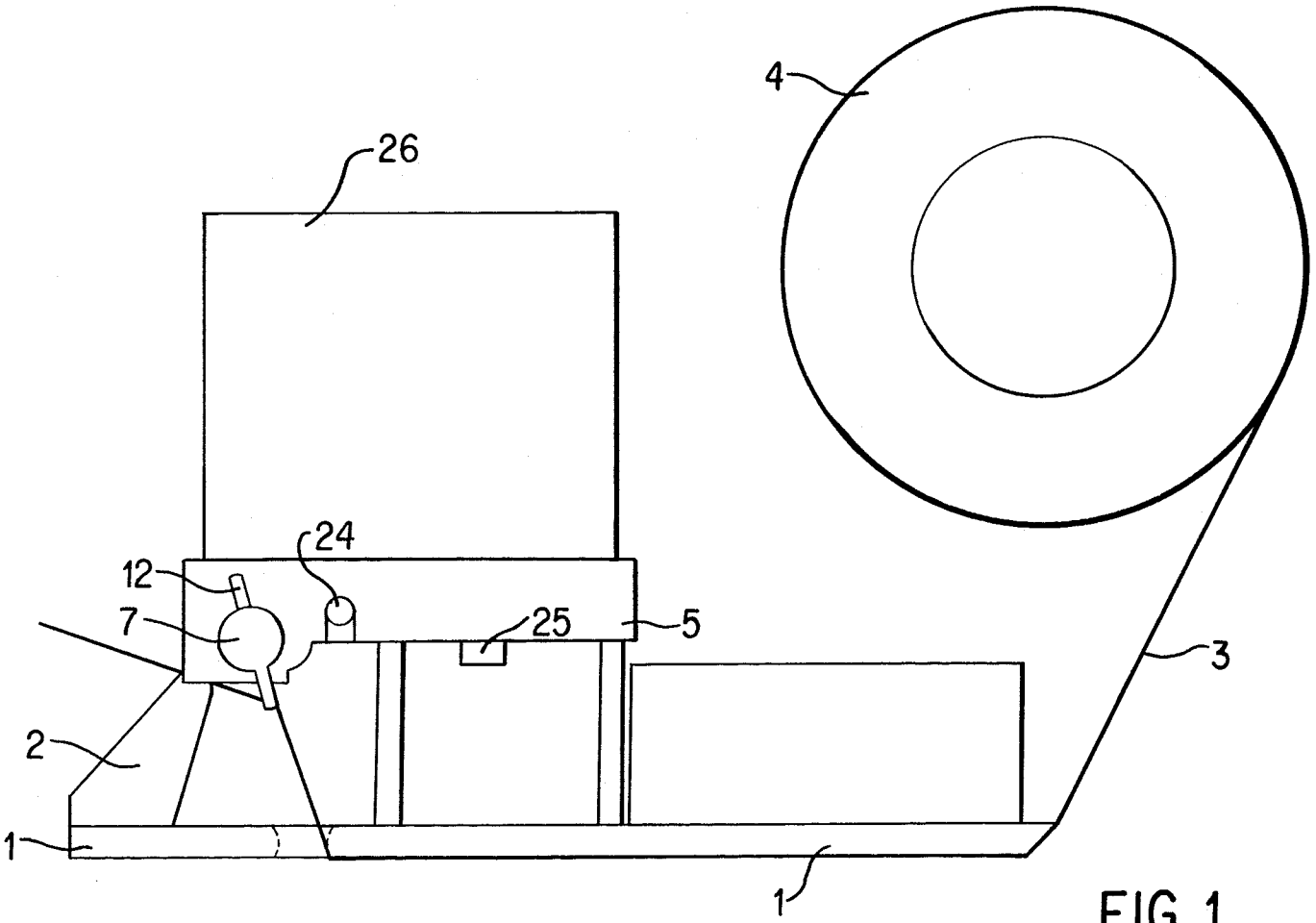
FIG. 1 is a side view of an automatic wax dispenser accomplished according to the present invention.

The depilatory wax automatic dispenser on depilatory strips essentially consists of a base member 1 supporting a mechanism 2 adapted to adjust the thickness of wax on a strip 3 of paper, cellophane or cotton fabric; said strip 3 uncoiling from a cartridge 4. Said base member 1 supports also a plate 5 of good heat conductor material. Said plate 5 having a cavity 6, better shown in FIGS. 3 and 4, which communicates at top with a pot 26 and at bottom with the external room via an opening delimited by two cylindric surfaces 8 and 9; said surfaces 8 and 9 opening on two opposite walls 10 and 11 which limit laterally said cavity 6 and which support a batcher cylinder 7. Said cylinder 7 is able to rotate from a first position shown in FIG. 3 to a second position shown in FIG. 4 under a force applied manually to a lever 12. Said lever 12 is U-shaped and is divided into three parts marked, respectively, with 12*a*, 12*b* and 12*c*. Said parts 12*a* and 12*c* being inserted in two radial holes 13*a* and 13*b* made in said cylinder 7.

During the use of the device it is possible to rotate the cylinder 7 both toward said first and said second position by applying a manual force to the part 12*a* or 12*c*.

To prevent a useless wax escape, a spring, not shown, is applied to a lever 12 to maintain the cylinder 7 at said first position during the phases in which the wax is not removed from the device.

Said cylinder 7 has a longitudinal groove 23 developing within said pot 26; said groove 23 being in communication with said cavity 6 and with an outlet part 22 so that the wax coming from said pot 26 is free to flow in said groove 23 with continuity, replacing the wax which goes out through said port 22 when said cylinder 7 is in said second position.

Figure 4:
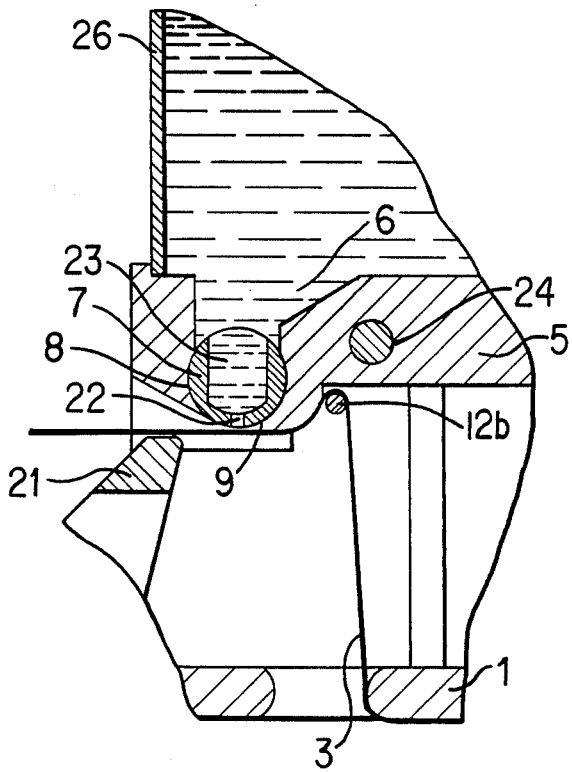

The part 12*b* of said lever 12 is adapted to stretch said strip 3 when said lever 12 is placed in the second position, shown in FIG. 4, to place said strip 3 in a nearly horizontal attitude most suitable for receiving the wax coming from said port 22.

Said mechanism 2 consists of an elastic sheet 14 adhering to said base member 1 in the contact zone between said sheet 14 and said base member 1. Said sheet 14 is integral with a structure 15 essentially comprising a downstream part 16 having a threaded drill 17 to house a micrometric controlled adjusting screw 18 having a knurled head 19; a groove 20 for receiving said head 19; a support part 21 for said strip 3; said support part 21 being placed near said batcher cylinder 7.

In use it is possible to raise or lower said part 21 by rotating said screw 18; in the first case said part 21 is brought near said port 22; in the second case said part 21 is taken away from said port 22. In fact the rotation of the screw 18 in a direction, for example in a clockwise direction, allows the lowering of the point of said screw 18 relative to said part 16 which, by engaging on said base member 1, pushes upward said structure 15, which due to the elasticity of said sheet 14 moves upward in turn and approaches said port 22. Therefore, by operating said adjusting screw 18, it is possible to place said part 21 at a desired position such that when said strip 3 leans on said part 21, a desired clearance between said strip 3 and said part 21 is obtained.

The device according with the present invention comprises further a candle-like resistance 24 inserted in said plate 5 near said cavity 6.

A commercial type temperature sensing feeler 25 is present in said base member 1; said feeler 25 being electrically connected to a temperature proportional adjusting device 45 able to adjust, in a known manner, the current crossing said resistance 24 to maintain at a predetermined constant temperature the wax housed in said cavity 6.

It is to be noted that the arrangement of the pot 26 relative to the cavity 6 favours the continuous replacement of the wax removed from said cavity 6 for falling on the below strip 3 but it maintains most of the wax at a temperature lower than that at which irreversible chemical transformations may occur or for which important thermal energy dispersion may take place.

Figure 3:
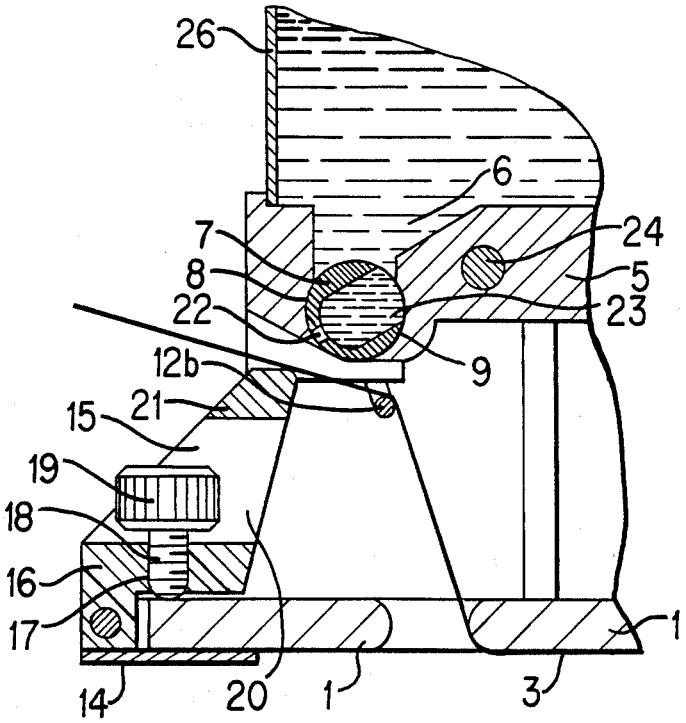
FIGS. 3–4 show a constructive detail of the same dispenser with said cylinder placed, respectively, at a closing and opening position.

As it is apparent from FIGS. 3–4, the dispenser device of the present invention is able to accomplish the following operations: when the cylinder 7 and the lever 12 are in the position shown in FIG. 3, the outlet port 22 is covered by the cylindric surface 8 and the strip 3 is sufficiently far from the wax delivery zone; when, on the countrary the cylinder 7 is at the position of FIG. 4, the outlet port 22 is open and the wax is able to flow with continuity to the below strip 3 assuming a thickness depending on the position of the part 21 of structure 15. The above mentioned structures are supported by a frame, not shown, which allows the strip 3 to slide from said cartridge 4 to a cutter device, not shown.

Constructive variations or additions can be brought to the invention or to parts thereof. One of these additions is shown in FIG. 6. It consists in a device for automatic advancement of said strip 3 and is constitued by an indented disk 27 rotatable with a shaft 28 supported by said part 21 of FIGS. 1–3; said disk 27 being coaxial to a first pulley 29 connected through a belt 30 to a second pulley 31 kinematically connected to a shaft of an electric motor, not shown. A second end of said shaft 28 supports integrally an analoguous indented disk, not shown.

Said electric motor is electrically connected to a tension source via a push-button panel, not shown, on disposal of the operator. This embodiment ensures a great precision in defining the thickness of wax to be placed on the strip 3 because it gives to said strip 3 a predetermined constant speed. Infact, the flow through outlet port 22 depends on the static load of the wax loading on said port 22.

Since the static load can be maintained constant by a device which will be disclosed below, the thickness of the wax on the strip 3 is maintained rigidly constant only if the translation speed is constant. This is allowed, in a more efficient manner, by a system similar to that one already disclosed which is controlled by a motor having a constant rotation speed.

In an other embodiment the electric motor can be controlled by a timer or a similar instrument, not shown, for permitting advancement of strip 3 for a predetermined period of time and, thence, for a predetermined length.

To maintain constant the static load of the melted wax loading on said port 22, a float system is provided for maintaining constant the wax level within said pot 26. This system, shown in FIG. 8, consists of a piping 32 which connects a wax reservoir 33 to a valve 34 controlled by a float 35 which receives positive bouyancy from the wax housed in said pot 26.

Said valve 34 can be, for example, a needle valve, which closes an outlet port from said piping 32 when said float 35 is shifted upward; a rod-like connecting element 36 being placed between said float 35 and said valve 34. An outlet 46 from said valve 34 permits the wax to flow toward said pot 26.

Figure 2:
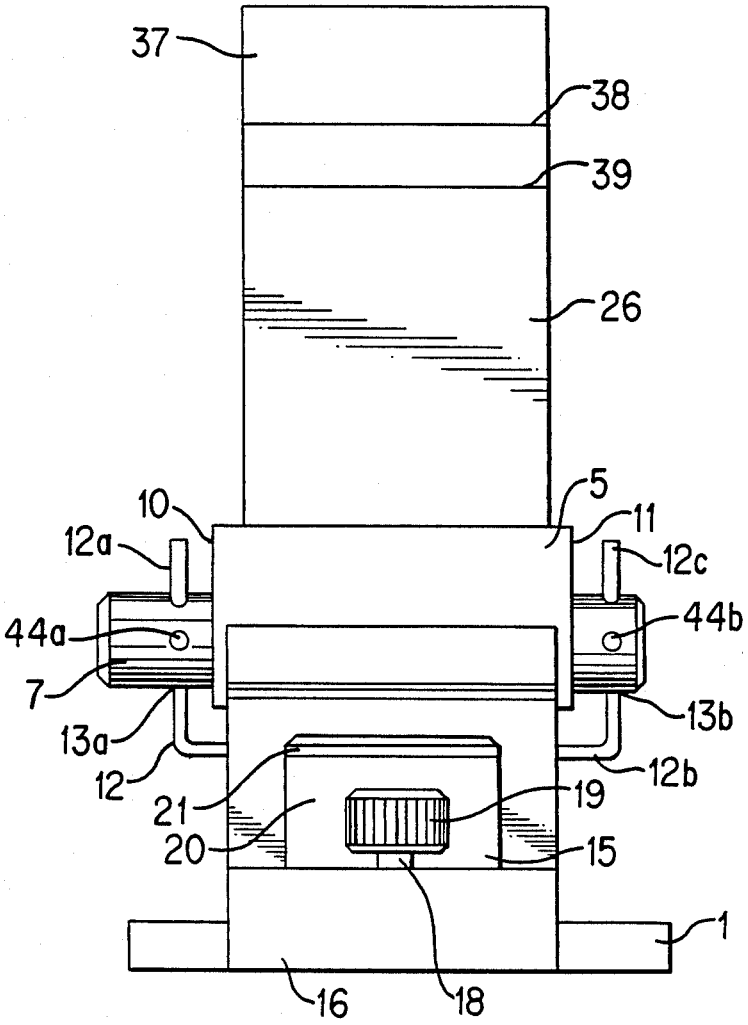
FIG. 2 is a front view of the dispenser shown in FIG. 1.

A less refined but cheaper control of the wax level within said pot can be obtained visually, as is apparent from FIG. 2, in which the pot 26 is provided with an upstream transparent part 37 and two level indicator lines 38 and 39, respectively, maximum and minimum.

When the level of the wax is below the line 39, the operator resets the level by introducing new wax in the pot 26 till it reaches the line 38.

It is clear that these lines 38 and 39 can be traced insisde the pot 26 provided that they are well visible.

In an other embodiment the mechanism 2 of the present invention is shown in FIG. 7; it consists of two levers **40*a* and 40*b* pivoted on said base member 1. Said lever 40*a* is fitted with a manual manoeuvering element 41 to rotate said levers 40*a* and 40*b* about a threadended pin 42. Said levers 40*a* and 40*b* support a rod 43 adapted to define the direction of said strip 3. The presence of the thread at the ends of said pin 42 prevents said rod 43 to shift under the slipping action of strip 3. To allow the placement of wax on said strip 3 with two layers having different width, the cylinder 7 is provided with two outlet ports 22*a* and 22*b*; the port 22*a* having a transversal size greater than port 22*b*. But in this case the positions allowing the opening of the outlet ports 22*a* and 22*b* are two; therefore it is necessary to obtain two positions for the lever 12 such that said lever 12 be arranged as in FIG. 4 both when the port 22*a* is open and when the port 22*b*** is open.

To accomplish this it is necessary to note that said port **22*a* and 22*b* have an angular distance $\omega$; if this same angular distance $\omega$ is plotted between holes 13*a* and 13*b* and two holes 44*a* and 44*b*, it is possible to insert said parts 12*a*, 12*c* of said lever 12** to obtain the intended purpose.

It is clear that the positioning of said holes **13*a* and 13*b* must be selected to allow the surfaces 8 and 9 to close, respectively and contemporaneously, said holes 22*a* and 22*b***.

Hereinbefore only preferred embodiments of the invention have been disclosed which can be added with variations not affecting its essence.

Shapes, dimensions and materials used do not limit the present invention in which each constructive particular can be replaced by an other technical equivalent.

I claim:

1. A depilatory wax automatic dispenser for dispensing wax on depilatory strips, said dispenser comprising: a pot for containing wax; a cavity placed at a bottom end of said pot and which communicates at a top portion with said pot and at a bottom portion with the ambient via an outlet; said dispenser further comprising a closing element for said outlet, said closing element being movable to a first closing position at which said outlet is closed and a second at least partial opening position at which said outlet is at least partially open; an electrical resistance means for heating said wax in said cavity; said electrical resistance means being adapted to be electrically connected to a known device adapted to adjust the intensity of the electric current passing through said resistance means; a coil cartridge having a strip wound therearound; a dragging means for dragging said strip from said cartridge to move said strip by said outlet; a first means cooperating with said dragging means to place said strip in a nearly horizontal attitude adjacent said outlet when said closing element is in said second position to enable wax from said cavity to be placed on said strip through said outlet; a second means for maintaining a clearance between said strip and said outlet as said strip is being moved to pass by said outlet; a third means for maintaining a constant wax level within said pot as said wax is being placed on said strip.

2. A dispenser as in claim 1 wherein said cavity is provided on a plate formed of a good heat conductor material and said cavity is adapted to support said pot; said resistance means being inserted in a hole made in said plate near said cavity.

3. A dispenser as in claim 1 wherein said closing element comprises a cylinder supported by a first and a second cylindrical surface formed in a wall of said cavity; said cylinder having a longitudinal groove open on one end toward an inner part of said pot and having at its other end at least one outlet port positioned away from said outlet of said cavity when said closing element is in said first position and positioned at said outlet of said cavity when said closing element is in said second position.

4. A dispenser as in claim 3 wherein said longitudinal groove is fitted with a first and a second said outlet port; said first outlet port having a longitudinal dimension greater than a longitudinal dimension of said second outlet port.

5. A dispenser as in claim 4 wherein said first and second outlet ports have an angular distance between them; said first outlet port being covered by said first cylindrical surface of said cavity wall and said second outlet port being covered by said second cylindrical surface of said cavity wall said cylinder is in said first position.

6. A dispenser as in claim 1 wherein said first means comprises a U-shaped lever having a first middle part for stretching said strip to position it in said nearly-horizontal attitude and two contiguous parts positioned contiguously, respectively, to a first and a second end of said first middle part, said two contiguous parts being insertable in radial holes formed in extremities of said cylinder external to said pot.

7. A dispenser as in claim 5, wherein said cylinder is fitted with at least a first and a second pair of holes; said first and said second pair of holes having an angular distance $\omega$ between them.

8. A dispenser as in claim 1 wherein said dragging means includes a pair of indented disks for automatic advancement of said strip, said disks being rotatable on a shaft and kinematically connected to an electric motor.

9. A dispenser as in claim 1 or 2 further comprising a base member supporting the dispenser wherein said second means comprises an elastic sheet adhering to said base member and integral with a structure accomodating a micrometrically controlled adjusting screw which has its point engaged on said base member; said structure having a support part for said strip placed near said outlet, said support part being movable up and down responsive to rotation of said adjusting screw to move toward and away from said outlet.

10. A dispenser as in claim 1 or 2 further comprising a base member supporting the dispenser wherein said second means comprises two levers pivoted on said base member and fitted with a manual maneuvering element for rotating said two levers about a pin having threaded ends; said two levers supporting a rod having its axis oriented perpendicular to the plane of said two levers and comprising means for controlling the direction of orientation of said strip.

11. A dispenser as in claim 1 wherein said third means comprises a valve connected to a float via a connecting rod; said valve having an inlet communicating with a wax reservoir via a piping for said wax and an outlet for depositing said wax from said piping into said pot.

* * * * *